United States Patent [19]

Bell et al.

[11] 4,382,341

[45] May 10, 1983

[54] METHOD FOR DRYING DRILLING MUD

[75] Inventors: Christy W. Bell, Berwyn; Charles H. Titus, Newtown Square, both of Pa.; Robert Y. Pogontchef, Alberta, Canada

[73] Assignee: Electro-Petroleum, Inc., Wayne, Pa.

[21] Appl. No.: 207,992

[22] Filed: Nov. 18, 1980

[51] Int. Cl.[3] ..... F26B 5/00

[52] U.S. Cl. ..... 34/1; 201/19; 204/149; 204/152; 219/284

[58] Field of Search ..... 204/149, 151, 152, 180 R; 201/19; 219/284; 34/1

[56] References Cited

U.S. PATENT DOCUMENTS

| | | | |
|---|---|---|---|
| 2,571,247 | 10/1951 | Huebotter | 204/180 |
| 2,919,898 | 1/1980 | Marwil et al. | 175/66 |
| 3,755,911 | 9/1973 | Candor et al. | 34/1 |
| 3,777,405 | 12/1973 | Crawford | 175/66 |
| 3,972,799 | 8/1976 | Taylor | 204/300 |
| 4,101,400 | 7/1978 | Pepping | 204/180 |

*Primary Examiner*—Larry I. Schwartz

*Attorney, Agent, or Firm*—Dann, Dorfman, Herrell and Skillman

[57] ABSTRACT

Direct electric current is passed through drilling mud contained in an earthen mud pit to dry the mud, thereby providing a safe and environmentally acceptable means for disposal of the mud.

10 Claims, 3 Drawing Figures

METHOD FOR DRYING DRILLING MUD

BACKGROUND OF THE INVENTION

This invention relates to a method for drying drilling mud and, more particularly, to a method for drying drilling mud in a containment means in the earth's surface, in which drying is effected by passing a direct electric current through the drilling mud.

Drilling mud, which is used in the rotary drilling of oil and gas wells, consists essentially of clay and water. Normally, it is introduced into the well under high pressure through the drill pipe from which it is discharged through openings in the drill bit to cool and lubricate the bit. Other functions of the drilling mud are to control gas, oil, and water pressures in the well, thereby preventing a blowout, and to help maintain the integrity of the walls of the well.

Pressure transmitted through the drill pipe forces the drilling mud through the annular space between the drill pipe and the walls of the well, and returns it to the surface along with the cuttings produced as the bit bores into the formation. Upon reaching the surface, the drilling mud is introduced into an earthen containment means adjacent to the well site, from which it is taken for recirculation through the well. The earthen containment means is commonly known as a settling sump or reserve pit.

As much as several thousand gallons of drilling mud may be used to drill a single well, and the reserve pit will normally contain approximately that amount of mud when the well is completed.

Since drilling mud often contains valuable additives, such as barium sulfate, which is used as a weighting agent, various methods have been proposed for separating and recovering the additives from the mud for further use. However, the prior art methods often require the use of specialized and relatively expensive equipment. Representative examples of prior art drilling mud reclaiming apparatus are shown in U.S. Pat. Nos. 3,777,405 and 3,972,799. These patents both relate to portable drilling mud reclamation apparatus which employ heat and electrolytic action, respectively, for accomplishing reclamation. Because of the expense involved in practicing the prior art reclamation methods, drilling mud is discarded in many instances and simply left in the reserve pit at the drilling site. This is often the practice with wildcaters, who randomly drill oil or gas wells in a locality not known to be productive.

Due to the substantial quantity of coloidal material present in the drilling mud, evaporation of the liquid content of the mud is very slow. Moreover, depending on the consistency of the soil at the drilling site, there may be little natural seepage of liquid from the mud pit. Abandoned mud-filled pits, therefore, pose potentially serious hazards in several respects. First, if left uncovered, as is sometimes the case, rain will cause the mud to overflow the pit. The runoff, which may contain chemical additives from the drilling mud, may carry into nearby streams and rivers, resulting in their contamination. Second, abandoned mud pits pose a potential threat to the well-being of livestock which may become mired in the mud and die. Third, if the drilling site is subsequently developed for other uses, construction equipment may become bogged down in an abandoned mud pit, and result in personal injury, delays in work schedules, or the like. These last-mentioned occurrences are especially likely where the mud pit has been covered over with soil and its location is not easily detectable.

Although it has been proposed to dispose of drilling mud by procedures involving mechanical dewatering apparatus and/or trucking to a safe disposal site, these procedures are expensive and have not been widely accepted.

The development of an effective method for drying existing or new reserve drilling mud pits continues to be a highly desired objective.

SUMMARY OF THE INVENTION

It has now been discovered, in accordance with the present invention, that drilling mud may be dried effectively in a containment means in the earth's surface by passing direct electric current through the mud.

The present invention provides an effective and practical way of drying drilling mud in existing or new reserve pits without the use of complex or expensive drying apparatus.

The present invention further provides a way of imparting a soil-like consistency to drilling mud, thereby obviating the potential health and safety hazards presented by abandoned mud pits.

This invention also provides a way of safely disposing of drilling mud which avoids the expense of pumping the mud from its containment means and mechanically drying and/or trucking it to a distant disposal site.

In general, the present invention involves providing in the earth's surface a drilling mud drying zone containing a quantity of drilling mud and including at least one electrically conductive element constituting an anode, and a liquid collection zone including at least one electrically conductive element constituting a cathode, the anode and the cathode being disposed in their respective zones, and the zones being positioned so as to permit the conduction of electric current through the drilling mud between the anode and the cathode; and applying across the electrodes a direct electric potential which is sufficient to cause current to pass therebetween, which in turn causes liquid present in the drilling mud to flow toward and accumulate adjacent to the cathode, thus drying the drilling mud.

In carrying out the present invention, the drying zone and the collection zone may be disposed adjacent to one another within a single containment means, or the drying zone and the collection zone may each be located in a separate containment means. In the latter case, the two containment means are separated by a medium that permits the conduction of electric current and the passage of water between the anode, which is in one of the containment means, and the cathode, which is in the other containment means.

The method of the present invention may be used to dry already existing mud pits, or mud pits which may be dug in the future to service new wells.

The novel features and advantages of the present invention will become apparent from the following description thereof in conjunction with the accompanying drawings illustrating the presently preferred way of carrying out the present invention, in which.

Figure 1:
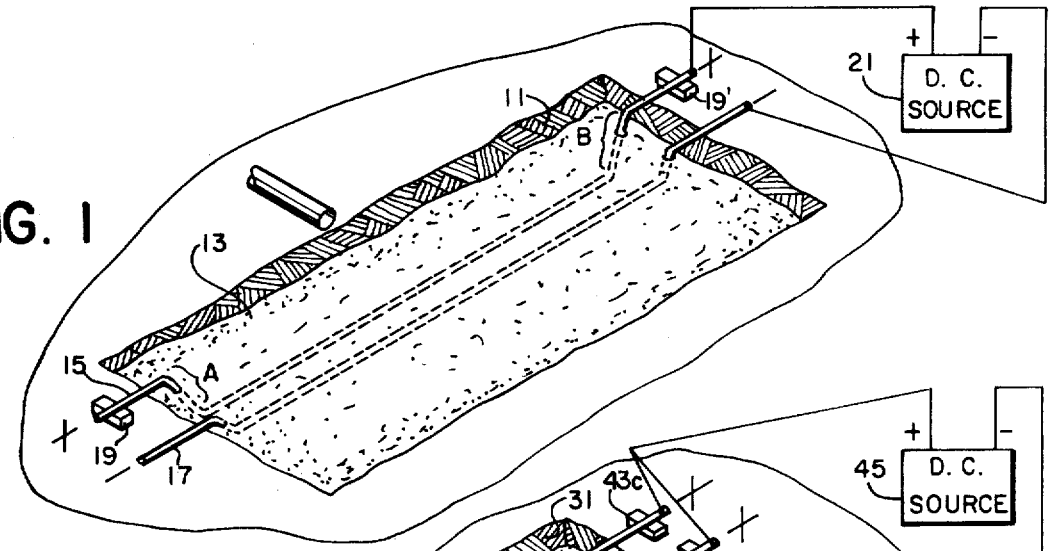
FIG. 1 is a perspective view illustrating the manner in which the mud drying zone and liquid collection zone may be provided in a single containment means.

Referring more specifically to the drawings, in FIG. 1 there is shown a single containment means or pit 11 in the earth's surface which is partially filled with a quantity of drilling mud designated 13. Ordinarily, the drilling mud is pumped directly into the containment means or pit from an adjacent well (not shown), but it may come from other sources, e.g., an off-shore drilling site. A pair of electrically conductive elements, 15 and 17, are arranged horizontally within and extend lengthwise across the containment means. The configuration of elements 15 and 17 conform generally to the contour of the containment means along its greatest dimension so that a substantial portion of each element is submerged horizontally in the drilling mud and extends out of the containment means at its opposite ends. Electrically conductive elements of the type shown may be conveniently fabricated from iron pipe or aluminum pipe. In the particular embodiment shown in FIG. 1, the conductive element 15 is mounted upon suitable insulators 19, and 19', such as wood blocks or short sections of fiberglass pipe, and element 17 is grounded. Alternatively, element 17 may be mounted on insulators, and element 15 grounded. The use of insulators is required to maintain a potential drop across the conductive elements.

In order to initiate drying of the drilling mud, conductive element 15 is connected to the positive terminal and conductive element 17 is connected to the negative terminal of D.C. voltage source 21, making element 15 an anode and element 17 a cathode. The potential of the voltage source must be sufficient to cause direct current to pass between the anode and the cathode.

After the direct current potential is applied across the electrodes, current begins to flow, and electroosmotic forces are generated in the drilling mud, causing liquid from the drilling mud to flow toward the cathode and accumulate in a liquid collection zone in the vicinity of the cathode. As the liquid flows toward the cathode, a zone of dried drilling mud develops in the vicinity of the anode. In the embodiment shown in FIG. 1, the liquid accumulated adjacent to the cathode must be removed from the containment means so that the liquid will not be reabsorbed into the drilling mud when current flow is interrupted. The zone of dried drilling mud expands as current continues to flow between the electrodes and liquid is removed from the containment means.

For convenience of operation, the method illustrated in FIG. 1 should be carried out with the cathode positioned above the anode, at or near surface of the drilling mud. In this manner, the liquid will tend to form a pool on the surface of the drilling mud, thus facilitating its removal from the containment means.

Figure 2:
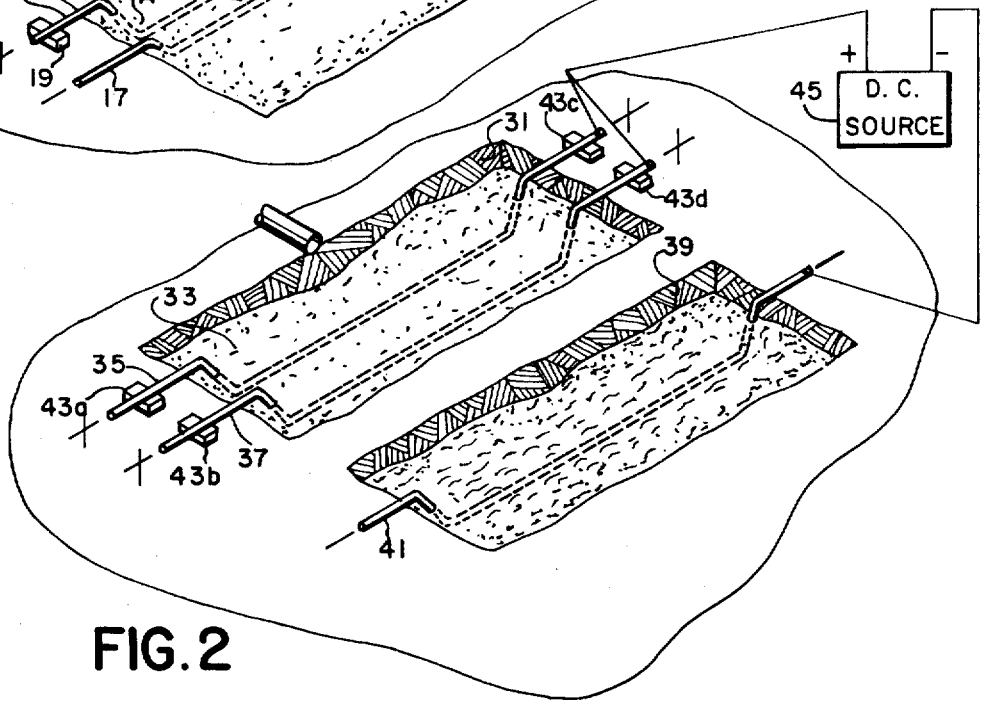
FIG. 2 is a perspective view illustrating the manner in which the mud drying zone and liquid collection zone may be provided in separate containment means.

In the embodiment shown in FIG. 2, the conductive elements for drying the drilling mud are provided in separate containment means. Containment means 31, which may be a pre-existing reserve pit, contains a quantity of drilling mud 33 and is provided with a pair of electrically conductive elements 35 and 37 which are arranged horizontally within, and extend across the length of the containment means in a manner similar to element 15 in FIG. 1.

Spaced apart from containment means 31 is auxiliary containment means 39 for the collection of liquid from the drilling mud. An electrically conduction element 41 is disposed horizontally within and extends across the length of containment means 39. The configuration of element 41 is similar to the corresponding element 17 shown in FIG. 1. In this embodiment also, the anodes are disposed in the drying zone, the cathode is disposed in the liquid collection zone, and the two zones are positioned so as to permit the conduction of electric current through the drilling mud between the electrodes. As illustrated in FIG. 2, elements 35 and 37 are insulated from ground by mounting upon suitable insulators 43*a*, 43*b*, 43*c* and 43*d*, and element 41 is grounded. Alternatively, element 41 may be insulated, and elements 35 and 37 grounded.

Containment means 31 and 39 which serve as drying zone and liquid collection zone, respectively, must be positioned sufficiently close to one another so that when the electrical potential is applied across the conductive elements, electric current and liquid will flow through the drilling mud and the medium 38, shown as a bridge of earth or ground, separating the two containment means 31 and 39. The spacing of the two containment means will depend to a certain extent on the resistivity of the medium separating them. The higher the resistivity of the medium, the closer together the two containment means must be positioned. Ordinarily, the medium separating the containment means will be the indigenous soil. However, if the soil is so compacted as to impede the passage of current or the flow of water between the electrodes in each containment means, as may be the case with soils composed largely of clay, it may be excavated and replaced by a more porous and/or electrically conductive medium, such as loose soil.

In arranging element 41 in auxiliary containment means 39, sufficient electrolyte solution must be provided in the containment means to allow electric current to pass between conductive element 41 and conductive elements 35 and 37 in containment means 31. Thus, when the method is carried out as shown in FIG. 2, containment means 39 should be provided with enough electrolyte solution to establish physical contact between the electrolyte solution and conductive element 41. The electrolyte solution together with the saline water in the earth surrounding containment means 39 enable electric current to flow between the electrodes. A certain amount of saline water may accumulate in containment means 30 as a result of natural seepage from the surrounding earth, thus reducing the amount of electrolyte solution that must be provided. Conductive element 41, may be disposed vertically rather than horizontally, as shown in FIG. 2, in which case the electrolyte solution normally will be provided by saline water present in the medium separating the containment means, as well as in the earth beneath the floor of each containment means. The vertically disposed cathode may take the form of a hollow electrically conductive pipe, which is driven into the floor of containment means 39. The buried portion of the pipe is preferably perforated, thus permitting water from the drilling mud to pass into the interior of the pipe from where it may be readily removed by means well known to those skilled in the art. As another alternative, an electrically conductive solid metal stake may be driven vertically into the floor of containment means 39 to serve as the cathode.

The drilling mud 33 in containment means 31 is dried by connecting the positive terminal of D.C. voltage source 45 to elements 35 and 37, which then act as anodes, and connecting the negative terminal of voltage source 45 to element 41, which then acts as a cathode. As direct electric current passes between the anodes and cathode, travelling through the drilling mud and the medium separating the containment means, liquid from the drilling mud migrates electroosmotically toward the cathode, thereby drying the drilling mud in containment means 31. The liquid from the drilling mud accumulates adjacent the cathode, eventually forming a pool in containment means 37. The accumulated liquid may be removed from containment means 39 by apparatus well known to those skilled in the art, such as a vacuum truck. However, since the liquid contains very little suspended matter, it may be left exposed to the atmosphere to evaporate. The quantity of drilling mud introduced into the drying zone for treatment in accordance with the present invention must be sufficient to establish physical contact with the anodes, the liquid present therein together with the saline water in the surrounding earth contributing to the conduction of electrical current through the drilling mud between the anode and the cathode.

Figure 3:
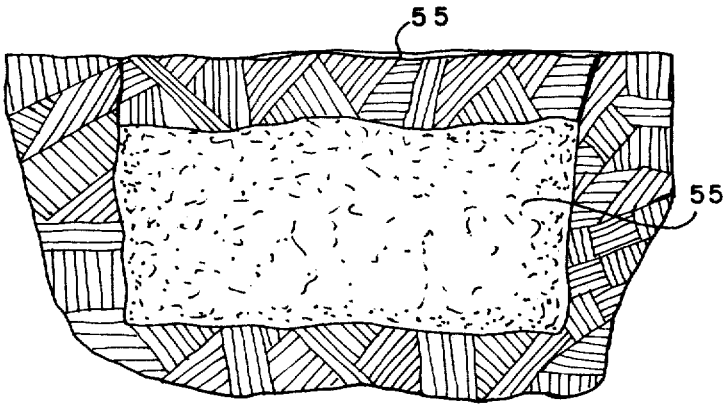
FIG. 3 is a view in cross-section showing a quantity of drilling mud which has been dried in accordance with this invention and covered over with a suitable-fill material.

After drying has proceeded to the extent that the drilling mud as a soil-like consistency, the electrodes are disconnected from the D.C. voltage source. As shown in FIG. 3, the drilling mud 53 is then covered over with a suitable fill material 55, such as top soil. If desired, the top soil may be seeded to prevent erosion. The electrodes are recovered from the drilling mud for further use, if desired, prior to covering with the fill material, or they may remain buried with the dried drilling mud. In effect, the method of the present invention accomplishes disposal of drilling mud without the transportation and other costs normally associated with land fill disposal.

The present invention is preferably practiced using a relatively low D.C. voltage of about 50 to about 500 volts and a direct current of 10 to 1000 amperes. Particular voltage and current values should be selected to remove the largest amount of liquid from the drilling mud at the lowest cost.

Although particular electrode configurations have been described above and illustrated in the drawings, other electrode configurations may be used as well. Electrodes made of electrically conductive screens or mesh constructed in various forms may be used instead of electrodes made of electrically conductive pipe. For example, a metal screen cathode may be disposed within the mud pit approximately concentrically with the walls of the pit so as to form a space between the screen cathode and the walls of the pit for the collection of water. Of course, the opening in the screen cathode must be sufficiently small to permit only the passage of the liquid component of the mud therethrough.

When pipe electrodes, such as those shown in the drawings, are employed, there is a possibility of malfunction due to the inability of the electrode to support the weight of drilling mud which may dry thereon. In order to avoid this potential problem, an additional cross member may be inserted between the downwardly inclined pipe sections, joining these sections and forming an inverted trapezoid with the major, horizontally disposed section of the electrode. Shorter pieces of pipe may be used to connect the base and top of the trapezoid to provide added strength.

Whatever the form of the electrodes, it is recommended, as a practical matter, to place the electrodes in the mud pit before filling it with drilling mud. This avoids the difficulty involved in submerging the electrodes into the mud in pre-existing drilling mud pits. Ideally, the electrodes should be provided in the pit at a well site before the well is drilled, so that power generated by the drilling rig may be used to initiate drying of the mud. By operating in this way, the pit may be dried, or nearly so, by the time the well is completed.

This invention will be further understood by reference to the following specific examples. In each of the examples, the containment means for the drilling mud was an earthen pit about 100 feet long by 60 feet wide by 12 to 14 feet deep at the deepest part. In the examples which follow, it should be understood that in order to utilize existing electrical equipment, approximately half of the power used was dissipated in a series connected resistor for controlling current.

Example 1 describes the result of a test in which drilling mud was dried according to the method using a single containment means, as illustrated in FIG. 1.

EXAMPLE 1

Two three-inch diameter electrically conductive line pipes made of iron were placed lengthwise in the mud pit and submerged in the mud. The pipes were spaced so that one was in the center of one-half of the pit and the other was in the center of the other half of the pit. One of the pipes was connected to the positive terminal of a D.C. voltage source to serve as the anode. The other was connected to the negative terminal of the D.C. voltage source to serve as the cathode. The ends of the anode were supported on insulators and the ends of the cathode were grounded. The water which accumulated adjacent the cathode was removed from the pit by vacuum truck. This test appeared to dry the pit rather rapidly.

About 16,600 kilowatt hours of power was used to dry an estimated 4000 barrels of mud over a four month period.

Examples 2 and 3 describe the results of tests in which drilling mud was dried according to the method using two containment means, as shown in FIG. 2, the containment means being located about 75 yards apart. In each of these examples, the electrically conductive elements provided in the mud pit were connected to the voltage source to act as anodes, whereas the single electrically conductive element provided in the liquid collection pit was connected to act as a cathode. Further, the ends of the anode were mounted on insulators and the ends of the cathode were grounded as illustrated in FIG. 2.

EXAMPLE 2

Two three-inch diameter electrically conductive iron pipes were placed lengthwise in the mud pit, and submerged in the mud splitting the pit into three approximately equal areas. The pipes were submerged in the mud. Approximately 48,000 kilowatt hours of power were used to dry an estimated 4,200 barrels of mud over a 90-day period.

EXAMPLE 3

A pair of electrically conductive aluminum irrigation pipes about three inches in diameter were placed transversely at one end of the mud pit and submerged in the mud. While in operation, a substantial part of the aluminum anodes dissolved into the mud, forming an aluminum-silicate type material that was extremely hard, but did not appreciably interfere with the drying operation.

85,000 kilowatt hours of power was used to dry 2,000 barrels of drilling mud over a ninety-day period.

Those skilled in the art will appreciate that the process described in the foregoing specification and examples are intended merely to illustrate and not to limit the invention. It will also be appreciated that the implementation of the above-described process is capable of wide variation and modification without departing from the spirit and scope of the invention as set forth in the appended claims.

We claim:

1. A method for drying drilling mud comprising the steps of:

a. providing in the earth's surface a drilling mud drying zone containing a quantity of drilling mud and including at least one electrically conductive element constituting an anode, and a liquid collection zone including at least one electrically conductive element constituting a cathode, said anode being disposed in said drying zone, said cathode being disposed in said collection zone, and said drying zone and said collection zone being positioned so as to permit the conduction of electric current through said drilling mud between said anode and said cathode; and b. applying across said anode and said cathode a direct electric potential which provides sufficient current to pass between said anode and said cathode, to cause liquid present in said drilling mud to flow toward and accumulate adjacent to said cathode in said liquid collection zone, thus drying said drilling mud.

2. The method claimed in claim 1 wherein said drying zone and said collection zone are defined, respectively, by first and second containment means, said containment means having walls separated by a medium, said walls and medium allowing the passage of said current and the flow of said liquid between said anode and said cathode.

3. The method claimed in claim 1 wherein said drying zone and said collection zone are defined by and are disposed adjacent one another within a single containment means, and the method includes removing liquid accumulated adjacent said cathode from said containment means.

4. The method claimed in claim 3 wherein a pre-existing drilling mud pit provides said single containment means and said quantity of drilling mud.

5. The method claimed in claim 3 or 4 wherein said anode and said cathode are arranged horizontally in said containment means, with said cathode positioned above said anode.

6. The method claimed in claims 1, 2 or 3 wherein the current passed between said anode and said cathode is in the range from about 10 to about 1000 amperes per electrode.

7. The method claimed in claims 1, 2 or 3 wherein the applied electrical potential is interrupted and the dried drilling mud is covered with a fill material.

8. A method for drying drilling mud present in a pre-existing containment means in the earth's surface, which comprises the steps of:

a. providing auxiliary containment means in the earth's surface spaced-apart from said pre-existing containment means, said pre-existing containment means and said auxiliary containment means having walls separated by a medium, said walls and medium allowing the conduction of electric current and the flow of liquid between said anode and said cathode;

b. providing at least one electrically conductive element constituting an anode in the drilling mud in said pre-existing containment means, and at least one electrically conductive element constituting a cathode in said auxiliary containment means, said anode being disposed in said pre-existing containment means and said cathode being disposed in said auxiliary containment means, and said pre-existing and said auxiliary containment means being positioned so as to permit the conduction of electric current through said drilling mud between said electrodes; and c. applying across said anode and said cathode a direct electric potential which provides sufficient current to pass through said medium between said anode and said cathode, to cause liquid present in said drilling mud in said pre-existing containment means to flow toward said cathode in said auxiliary containment means, thus drying said drilling mud.

9. The method claimed in claim 8 wherein the current passing between said anode and said cathode is in the range from about 10 to 1000 amperes per electrode.

10. The method claimed in claim 8 wherein the applied electrical potential is interrupted and the dried drilling mud is covered with a fill material.

* * * * *